US009342004B1

(12) United States Patent
Kodera et al.

(10) Patent No.: US 9,342,004 B1
(45) Date of Patent: May 17, 2016

(54) HEATING DEVICE, FIXING DEVICE, AND IMAGE FORMING APPARATUS

(71) Applicant: FUJI XEROX CO., LTD., Tokyo (JP)

(72) Inventors: Tetsuro Kodera, Kanagawa (JP); Takashi Matsubara, Kanagawa (JP); Tomoko Miyahara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/808,401

(22) Filed: Jul. 24, 2015

(30) Foreign Application Priority Data

Jan. 16, 2015 (JP) ..... 2015-006855

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/201
USPC ..... 399/329, 336
See application file for complete search history.

(56) References Cited

U.S. PATENT DOCUMENTS

2014/0241765 A1 8/2014 Kodera

FOREIGN PATENT DOCUMENTS

JP 2006003694 A * 1/2006
JP 2014-164022 A 9/2014

OTHER PUBLICATIONS

Machine Translation of JP 2006003694.*

* cited by examiner

*Primary Examiner* — David Bolduc
*Assistant Examiner* — Barnabas Fekete
(74) *Attorney, Agent, or Firm* — Oliff PLC

(57) ABSTRACT

Provided is a heating device, including a transparent belt that travels along a determined path, a first transparent member that comes into contact with an outer circumferential surface of the belt to form a nip at a first position in the belt, and an irradiating section that irradiates a beam which reaches a second position which comes into contact with a heating-target member and differs from the first position in a circumferential direction of the belt via the transparent member and the nip.

19 Claims, 6 Drawing Sheets

HEATING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-006855 filed Jan. 16, 2015.

BACKGROUND

Technical Field

The invention relates to a heating device, a fixing device, and an image forming apparatus.

SUMMARY

According to an aspect of the invention, there is provided a heating device, including:

a transparent belt that travels along a determined path;

a first transparent member that comes into contact with an outer circumferential surface of the belt to form a nip at; a first position in the belt; and an irradiating section that irradiates a beam which reaches a second position which comes into contact with a heating-target member and differs from the first position in a circumferential direction of the belt via the transparent member and the nip.

BRIEF DESCRIPTION OF THE DRAWINGS

Exemplary embodiments of the present invention will be described in detail based on the following figures, wherein.

DETAILED DESCRIPTION

Outline

Figure 1:
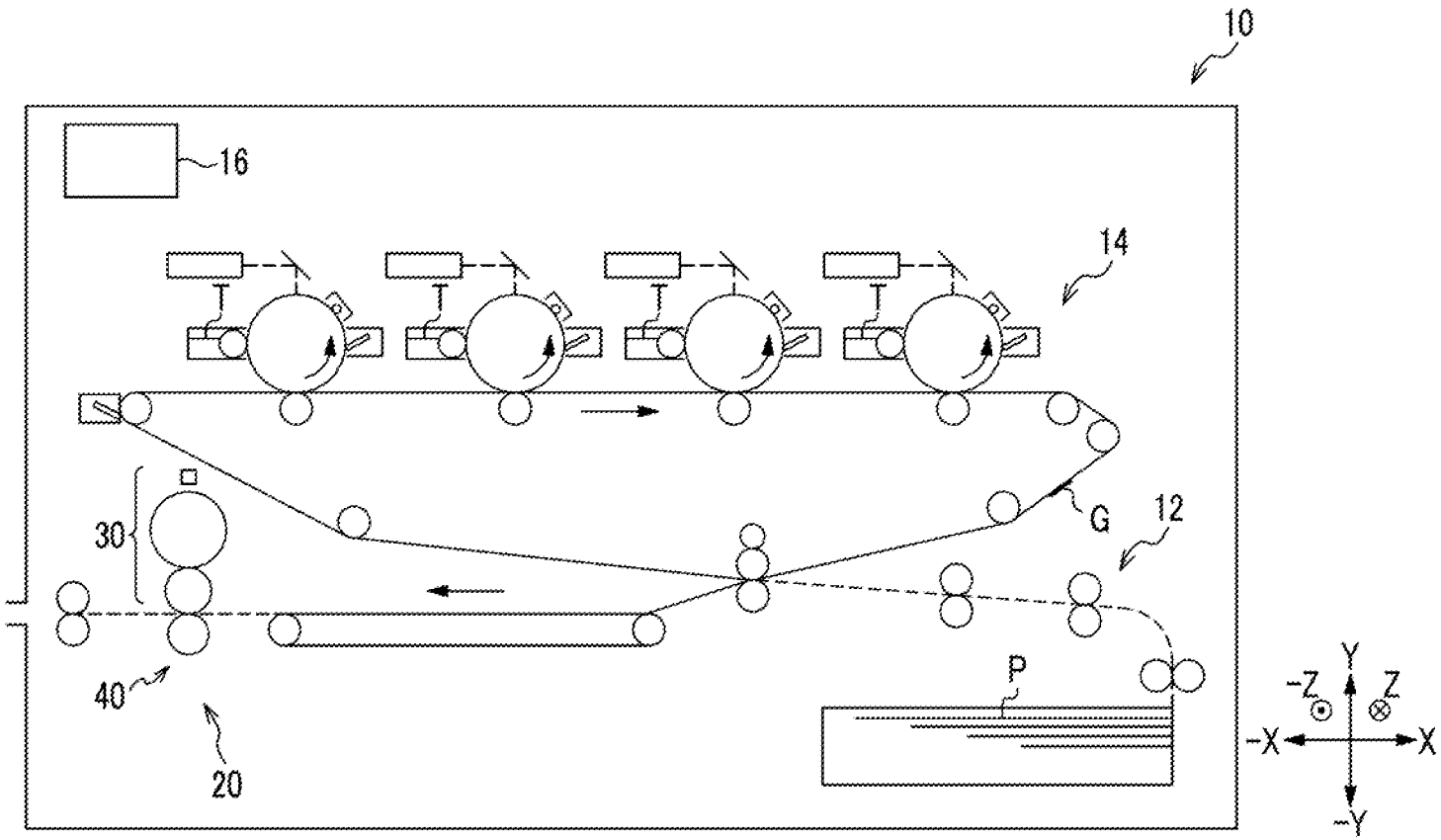
FIG. 1 is a schematic diagram (a front diagram) illustrating an image forming apparatus of a first exemplary embodiment.

Hereinafter, description will be given of three exemplary embodiments (the first to third exemplary embodiments) for carrying out the invention (hereinafter referred to as exemplary embodiments), with reference to the drawings.

In the description hereinafter, a direction indicated by arrows X and −X in the drawings is an apparatus width direction, and a direction indicated by arrows Y and −Y in the drawings is an apparatus height direction. A direction (a direction of arrows Z and −Z) which orthogonally intersects both the apparatus width direction and the apparatus height direction is an apparatus depth direction. When it is necessary to distinguish one side from another side with regard to the apparatus width direction, the apparatus height direction, and the apparatus depth direction, the arrow X side is one side, the arrow −X side is the other side, the arrow Y side is the top side, the arrow −Y side is the bottom side, the arrow Z side is the far side, and the arrow −Z side is the near side.

First Exemplary Embodiment

Outline

Hereinafter, description will be given of the present exemplary embodiment. First, description will be given of the overall configuration of an image forming apparatus 10 of the present exemplary embodiment. Next, description will be given of a configuration of a fixing device 20 of the present exemplary embodiment. Next, description will be given of the operations of the image forming apparatus 10 of the present exemplary embodiment. Next, description will be given of the operations of the present exemplary embodiment.

Overall Configuration of Image Forming Apparatus

As illustrated in FIG. 1, the image forming apparatus 10 is an electrophotographic system image forming apparatus which is configured to include a transporting section 12, a toner image forming section 14, a control section 16, and the fixing device 20. The transporting section 12 includes a function of transporting a medium P. The toner image forming section 14 includes a function of forming a toner image G which is formed of a toner T on the transported medium P by performing the processes of charging, exposing, developing, and transferring. The control section 16 includes a function of controlling the components other than the control section 16 which configures the image forming apparatus 10. The fixing device 20 includes a function of fixing the toner image G on the medium P. Here, the toner image G is an example of a developer image and an example of a heating-target member. The toner image forming section 14 is an example of a forming unit.

Fixing Device

Figure 2:
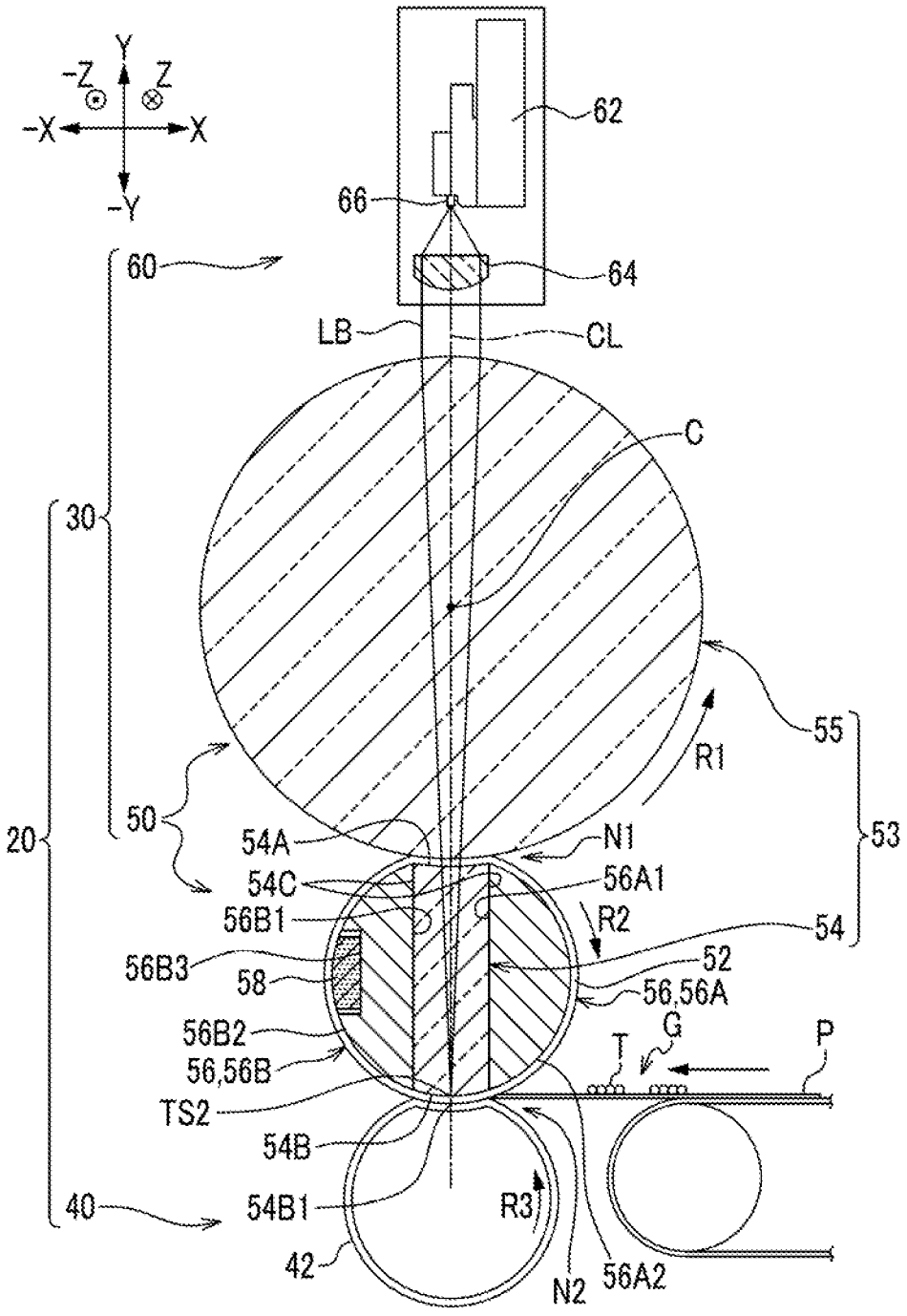
FIG. 2 is a schematic diagram (a front diagram) illustrating a fixing device which configures the image forming apparatus of the first exemplary embodiment.

As illustrated in FIG. 2, the fixing device 20 is configured to include a heating section 30 and a pressurizing section 40. Here, the heating section 30 is an example of a heating device.

Heating Section

The heating section 30 includes a function of heating the toner image G which is forced on the medium P by the toner image forming section 14. The heating section 30 is provided with a main body 50 and an irradiating section 60.

Main Body

The main body 50 is provided with a transparent belt 52, a cap (not shown), a gear (not shown), a lens 53, a guide section 56, and a lubricant supply section 58 (hereinafter referred to as the supply section 58). Here, the transparent belt 52 is an example of a transparent belt.

Transparent Belt

The transparent belt 52 is cylindrical, and is disposed in a state in which an axis thereof is aligned with the apparatus depth direction. The cap (not shown) is fitted to the end portion of the near side of the transparent belt 52 in the apparatus depth direction, and the gear (not shown) is fitted to the end portion of the far side in the apparatus depth direction. The transparent belt 52 is configured to travel along a determined path as the gear (not shown) is rotated around an axis (the axis of the gear) by a drive source (not shown). Here, the determined path will be referred to as the path in which the transparent belt 52 in FIG. 2 rotates around the axis (in an arrow R2 direction in the drawing). The arrow R2 direction in the drawing is the travel direction of the transparent belt 52.

The transparent belt 52 is configured to rotate around the axis following a cylindrical member 42 as the cylindrical member 42 (described later) rotates around the axis. The drive source includes a function (a function of assisting the driven rotation of the transparent belt 52 by the cylindrical member 42) of driving the transparent belt 52 such that the circumferential velocity of the transparent belt 52 is the same as the circumferential velocity of the cylindrical member 42. Therefore, the drive torque used by the drive source to cause the transparent belt 52 to rotate is less than the drive torque used by the drive source (not shown), which causes the cylindrical member 42 to rotate, to cause the cylindrical member 42 to rotate.

The transparent belt 52 is configured to transmit a portion of a beam LB (laser beam) which is irradiated by the irradiating section 60 (described later). In the present exemplary embodiment, the transmittance (the percentage of the beam LB which is emitted from the inner circumferential surface of the transparent belt 52 after entering from the outer circumferential surface and passing through the transparent belt 52) of the beam LB which is irradiated by the irradiating section 60 in the transparent belt 52 is 95%, for example.

Figure 3:
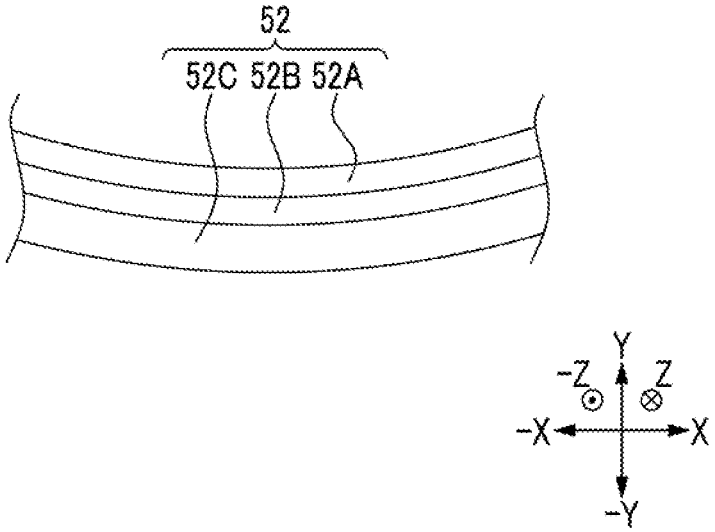
FIG. 3 is a partial sectional diagram illustrating the layer configuration of a transparent belt which configures the fixing device of the first exemplary embodiment.

As illustrated in FIG. 3, the transparent belt 52 is formed of three layers from the inner circumferential side through to the outer circumferential side, a base layer 52A, an elastic layer 52B, and a release layer 52C. The elastic layer 52B is laminated onto the base layer 52A, and the release layer 52C is laminated onto the elastic layer 52B. Note that, the base layer 52A maintains a strength which is necessary for the transparent belt 52, the elastic layer 52B provides the transparent belt 52 with the properties of an elastic member, and the release layer 52C includes a function of ensuring that the heated toner T on the medium P is not easily offset from the transparent belt 52.

Lens

As illustrated in FIG. 2, the lens 53 includes a function of focusing the incident beam LB which is irradiated by the irradiating section 60 on a determined position of the transparent belt 52 (a position of a curved surface 54B (described later) which comes into contact with a peak portion 54B1). The lens 53 includes a first lens 54 and a second lens 55. Here, the first lens 54 is an example of another transparent member. The second lens 55 is an example of a transparent member. The first lens 54 and the second lens 55 of the present exemplary embodiment are glass, for example. The refractive index of the beam LB in the first lens 54 and the second lens 55 is set to 1.5.

First Lens

As illustrated in FIG. 2, the first lens 54 is disposed within the transparent belt 52. As viewed from the apparatus depth direction, the first lens 54 is long, and is disposed in a state in which the longitudinal direction thereof is aligned with the apparatus height direction. As viewed from the apparatus width direction, the first lens 54 is long, and is disposed in a state in which the longitudinal direction thereof is aligned with the apparatus depth direction (not shown).

The end portion (one end) of the top side of the first lens 54 in the apparatus height direction is a concave surface 54A which is depressed to be a curved shape in the bottom side of the apparatus height direction. The edge of the concave surface 54A of the present exemplary embodiment is formed in an arc with the same curvature as the curvature of the second lens 55 (described later) as viewed sectionally from the apparatus depth direction. The first lens 54 comes into contact with the transparent belt 52 from the inner circumferential side of the transparent belt 52 via silicone oil (described later) by the portion (the concave portion) in which the concave surface 54A is formed. Note that, the concave surface 54A is formed in the entire region of the first lens 54 in the apparatus width direction.

The curved surface 54B which protrudes to the bottom side in the apparatus height direction is formed in the end portion (the other end) of the bottom side of the first lens 54 in the apparatus height direction. The transparent belt 52 is wound around the portion of the first lens 54 in which the curved surface 54B is formed via the silicone oil. In other words, the first lens 54 comes into contact with the transparent belt 52 from the inner circumferential side of the transparent belt 52 via the silicone oil by the curved surface 54B. Note that, the curved surface 54B includes the peak portion 54B1, which protrudes furthest, on the bottom side of the curved surface 54B in the apparatus height direction. Planes 54C which are aligned with the apparatus height direction are formed on both ends of the first lens 54 in the short direction as viewed from the apparatus depth direction.

As viewed from the apparatus depth direction, the first lens 54 has line symmetry across a virtual line (a dot-dash line CL in the drawing) along the apparatus height direction which passes through the peak portion 54B1. Note that, the virtual line CL is an optical axis of the beam LB which enters the first lens 54 as viewed from the apparatus depth direction.

Second Lens

As illustrated in FIG. 2, the second lens 55 is disposed on the opposite side from the first lens 54 to interpose the transparent belt 52, and forms a nip N1 with the first lens 54. The second lens 55 is cylindrical, is capable of rotating around an axis, and is disposed such that the axis of the second lens 55 is aligned with the apparatus depth direction. The second lens 55 is harder than the transparent belt 52. Therefore, when the second lens 55 forms the nip N1 with the first lens 54 by interposing the transparent belt 52, the transparent belt 52 is deformed (depressed).

A slippage bearing (not shown) which is pressed by a compressed spring from the top side is fitted to each end of the second lens 55 in the apparatus depth direction. A gear (not shown) is fitted to the end portion of the far side of the second lens 55 in the apparatus depth direction. The second lens 55 is configured to rotate around an axis C as the gear (not shown) is rotated around an axis (the axis of the gear) by the drive source (not shown).

Since the configuration described above is adopted, the lens 53 proceeds in the apparatus height direction and is configured to focus the beam LB which enters the second lens 55 on a portion of the transparent belt 52 which comes into contact with the peak portion 54B1 of the first lens 54 via the nip N1 and the first lens 54. Here, the portion of the transparent belt 52 at which the nip N1 is formed is an example of a first position. The portion of the transparent belt 52 which comes into contact with the peak portion 54B1 of the first lens 54 is an example of a second position.

Guide Section

As illustrated in FIG. 2, the guide section 56 includes a function of interposing the first lens 54 from both sides in the apparatus width direction to support the first lens 54, and a function of guiding the transparent belt 52 which rotates around the axis such that the transparent belt 52 rotates while maintaining a cylindrical shape. The guide section 56 is provided with a first guide section 56A and a second guide section 56B. Both the first guide section 56A and the second guide section 56B are long, and are disposed on the inside of the transparent belt 52 in a state in which the longitudinal direction thereof is aligned with the apparatus depth direction.

A plane 56A1 is formed on one side (the –X direction side) of the first guide section 56A in the apparatus width direction, and is aligned with the apparatus height direction as viewed from the apparatus depth direction. A curved surface 56A2 is formed on the other side (the X direction side) of the first guide section 56A in the apparatus width direction, and protrudes to the other side in the apparatus width direction as viewed from the apparatus depth direction.

A curved surface 56B2 is formed on one side of the second guide section 56B in the apparatus width direction, and protrudes to one side in the apparatus width direction as viewed from the apparatus depth direction. A plane 56B1 is formed on the other side of the second guide section 56B in the apparatus width direction, and is aligned with the apparatus height direction as viewed from the apparatus depth direction. Note that, a concave portion 56B3 which is open to one side in the apparatus width direction is formed in the curved surface 56B2 across the entire region in the apparatus depth direction. The supply section 58 (described later) is accommodated in the concave portion 56B3.

The width of the plane 56A1 and the plane 56B1 in the short direction is the same as the width of the plane 54C of the first lens 54 in the short direction. The guide section 56 supports the first lens 54 in a state in which the entire region of the plane 56A1 of the first guide section 56A overlaps the entire region of the plane 54C of the other side of the first lens 54 in the apparatus width direction, and the entire region of the plane 56B1 of the second guide section 56B overlaps the entire region of the plane 54C of one side of the first lens 54 in the apparatus width direction.

Note that, as described earlier, the concave surface 54A of the first lens 54 is depressed to be a curved shape in the bottom side of the apparatus height direction. The top and bottom end portions of the boundary between the curved surface 56A2 and the concave surface 54A, and the boundary between the curved surface 56B2 and the concave surface 54A match as viewed from the apparatus depth direction. The curvature of the curved surface 56A2 of the first guide section 56A and the curved surface 56B2 of the second guide section 56B is the same as the curvature of the curved surface 54B of the first lens 54. Therefore, the boundary between the curved surface 56A2 and the curved surface 54B and the boundary between the curved surface 56B2 and the curved surface 54B are joined by a continuous curved surface as viewed from the apparatus depth direction.

Supply Section

The supply section 58 includes a function of supplying a silicone oil (not shown) which is an example of a lubricant to the inner circumferential surface of the transparent belt 52. Note that, the silicone oil is for reducing the friction of the transparent belt 52 with the first lens 54 by being interposed between the concave surface 54A and the curved surface 54B of the first lens 54 and the inner circumferential surface of the transparent belt 52 which rotates around the axis. The silicone oil may transmit the beam LB.

The supply section 58 is long. As illustrated in FIG. 2, the supply section 58 is accommodated in a state in which a portion thereof protrudes from the inside of the concave portion 56B3 which is formed in the second guide section 56B in a state in which the longitudinal direction of the supply section 58 is aligned with the apparatus depth direction. The portion of the supply section 58 which protrudes from the concave portion 56B3 comes into contact with the inner circumferential surface of the transparent belt 52. The supply section 58 of the present exemplary embodiment is formed of a felt material, for example, and the felt material is impregnated with the silicone oil. Therefore, the supply section 58 is configured to supply the silicone oil with which the supply section 58 is impregnated to the portion of the inner circumferential surface of the transparent belt 52 with which the supply section 58 comes into contact. As a result, the silicone oil with which the supply section 58 is impregnated is supplied to the entire region of the inner circumferential surface of the transparent belt 52 due to the transparent belt 52 rotating around the axis.

Irradiating Section

The irradiating section 60 includes a function of irradiating the beam LB which enters the second lens 55. From another perspective, the irradiating section 60 includes a function of irradiating a beam which is focused on and reaches the second position. The second position is a position at which the medium P comes into contact via the second lens 55 and the nip N1, and differs from the first position in the circumferential direction of the transparent belt 52. From yet another perspective, the irradiating section 60 includes a function of irradiating the beam LB for heating the toner image G which is formed on the medium P. As illustrated in FIG. 2, the irradiating section 60 is provided with a laser array 62 and a collimating lens 64. In the heating section 30 of the present exemplary embodiment, plural irradiating sections 60 are arranged along the apparatus depth direction. The irradiating sections 60 are disposed above the transparent belt 52. Each laser array 62 is configured by plural light sources 66 being arranged along the apparatus depth direction.

The light source 66 is configured to cause the beam LB to be incident on the topmost portion in the apparatus height direction such that the optical axis CL of the beam LB which proceeds along the apparatus height direction overlaps the topmost portion in the apparatus height direction, which is the outer circumferential surface of the second lens 55 which rotates around the axis as viewed from the apparatus depth direction. Specifically, the light source 66 is disposed in a position at which the optical axis CL overlaps the peak portion 54B1 of the first lens 54, the topmost portion of the second lens 55 in the apparatus height direction, and the axial center C of the second lens 55 as viewed from the apparatus depth direction.

Description is given of the heating section 30 above. Here, to summarize the heating section 30, the heating section 30 is provided with the transparent belt 52, the lens 53, and the irradiating section 60. The transparent belt 52 travels along a predetermined path, the lens 53 includes the first lens 54 and the second lens 55, and focuses the beam LB which enters the second lens 55 onto the second position via the nip N1 and the first lens 54, and the irradiating section 60 irradiates the beam LB which enters the second lens 55. The first lens 54 comes into contact with the transparent belt 52 from the inner circumferential side at the first position and at the second position, and the second lens 55 forms the nip N1 with the first lens 54 by interposing the transparent belt 52 at the first position. The second position is a different position from the first position in the circumferential direction and is a position at which the transparent belt 52 comes into contact with the heating-target member P by the outer circumference of the transparent belt 52.

Pressurizing Section

As illustrated in FIG. 2, the pressurizing section 40 includes a function of coming into contact with the outer circumferential surface of the transparent belt 52 on the opposite side from the curved surface 54B of the first lens 54 to interpose the transparent belt 52, and, with the transparent belt 52, forming a nip N2 through which the toner image G, which is formed on the surface of the medium P, passes with the surface thereof facing the transparent belt 52 side. The pressurizing section 40 includes a function of pressurizing the medium P with the first lens 54 at the nip N2. Here, the nip N2 is an example of the nip of the second position.

The pressurizing section 40 is provided with the cylindrical member 42, a cap (not shown), and a gear (not shown). The cylindrical member 42 is disposed to align with the apparatus depth direction. The cap (not shown) is fitted to the end portion of near side of the cylindrical member 42 in the apparatus depth direction, and the gear (not shown) is fitted to the end portion far side in the apparatus depth direction. The cylindrical member 42 is configured to rotate around an axis (in an arrow R3 direction in the drawings) as the gear (not shown) is rotated around an axis (the axis of the gear) by the drive source (not shown).

The cylindrical member 42 is configured to be deformable, and forms the nip N2 in a state in which the transparent belt 52 with which the cylindrical member 42 is in contact digs into a portion of the cylindrical member 42 of the opposite side from the curved surface 54B of the first lens 54 which interposes the transparent belt 52. The nip N2 is formed to include the portion of the outer circumferential surface of the transparent belt 52 which faces a center portion TS2 of the curved surface 54B. Therefore, the cylindrical member 42 is configured such that the beam LB which is irradiated by the light source 66 is focused on a portion at which the cylindrical member 42 pressurizes the medium P and which comes into contact with the peak portion of the curved surface 54B of the first lens 54.

Supplementary Description

Hereinafter, supplementary description will be given of the configuration of the fixing device 20. As described earlier, the refractive index of the beam LB in the first lens 54 and the second lens 55 is 1.5. The optical axis CL of the beam LB which enters the second lens 55 overlaps the axis C of the second lens 55 as viewed from the apparatus depth direction, as illustrated in FIG. 2. The beam LB which passes through the second lens 55 enters the concave surface 54A of the first lens 54, is output from the curved surface 54B, and is focused on the second position in the transparent belt 52. Therefore, as viewed from the apparatus depth direction, the length from the position at which the beam LB enters the second lens 55 in the optical axis CL to the second position of the transparent belt 52 is in a relationship of being 1.5 times the diameter of the second lens 55 when ignoring the refractive index of the transparent belt 52.

The configuration of the image forming apparatus 10 and the configuration of the fixing device 20 of the present exemplary embodiment are described above.

Operations of Image Forming Apparatus

Next, description will be given of the operations of the image forming apparatus 10 of the present exemplary embodiment with reference to the drawings.

The control section 16 which receives an image forming command causes the transporting section 12, the toner image forming section 14, and the fixing device 20 to operate. Then, in the toner image forming section 14, the processes of charging, exposing, developing, and transferring are performed, and the toner image G is formed on the medium P which is transported by the transporting section 12. The medium P on which the toner image G is formed is transported toward the fixing device 20 by the transporting section 12. The medium P on which the toner image G is formed passes through the nip N2 which is formed by the transparent belt 52 and the cylindrical member 42 in the fixing device 20. In this case, the toner image G on the medium P is pressurized by the cylindrical member 42. As described earlier, since the cylindrical member 42 is configured such that the beam LB which is irradiated by the light source 66 is focused on the portion of the cylindrical member 42 which pressurizes the medium P, the toner image G on the medium P is heated by the beam LB which is focused on the curved surface 54B of the first lens 54 during a portion of a period during which the toner image G on the medium P passes through the nip N2. Accordingly, the toner image G on the medium P which passes through the nip N2 is fixed onto the medium P. The medium P onto which the toner image G is fixed is output to the outside of the image forming apparatus 10, and the operations of the image forming apparatus 10 are completed.

The operations of the image forming apparatus 10 are described above.

Operations

Next, description will be given of the operations of the present exemplary embodiment with reference to the drawings.

First Operation

Figure 4:
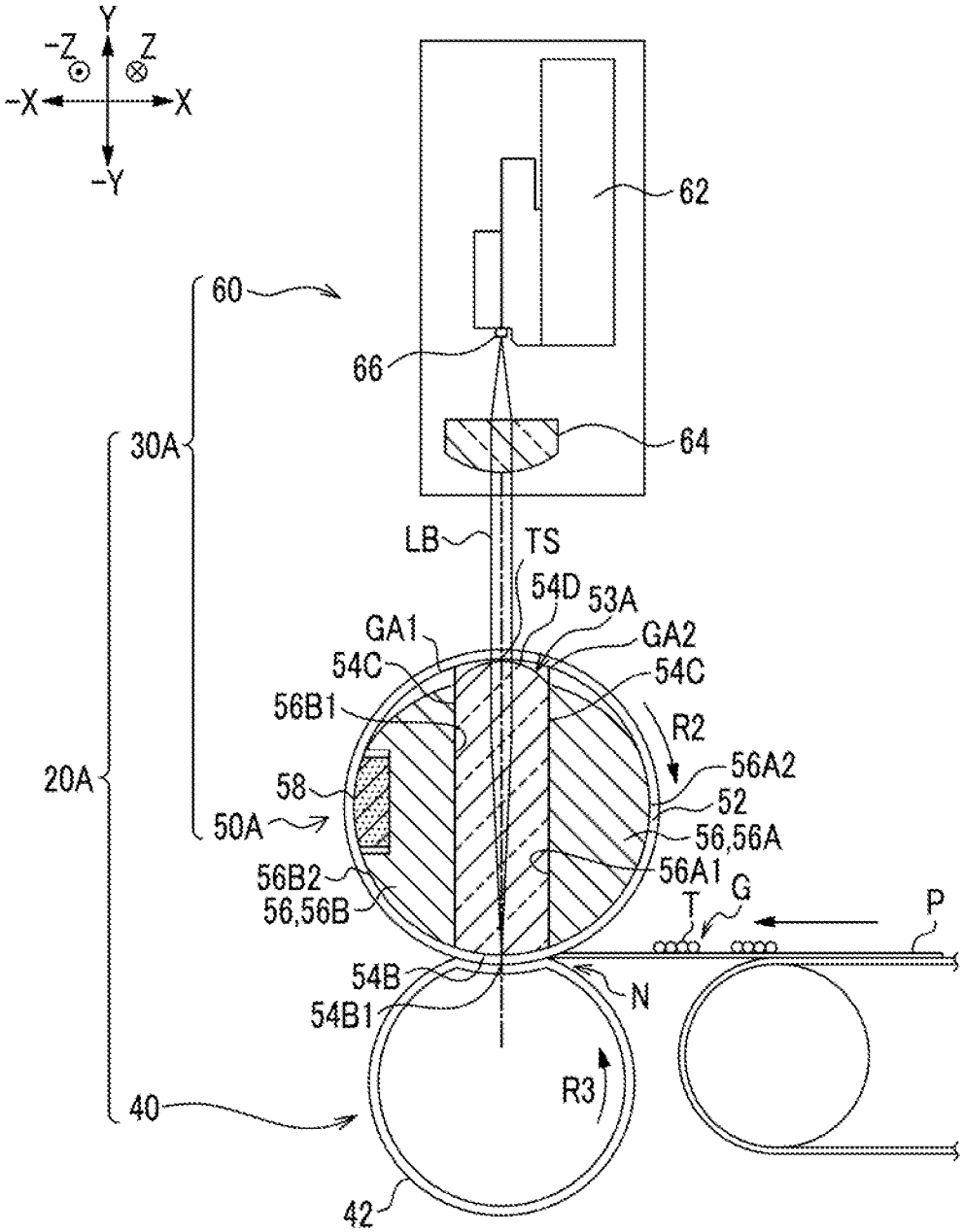
FIG. 4 is a schematic diagram (a front diagram) illustrating a fixing device which configures an image forming apparatus of a comparative embodiment.

As illustrated in FIG. 4, in a heating section 30A of the comparative embodiment, the configuration of a main body 50A differs in relation to the heating section 30 of the present exemplary embodiment. Specifically, whereas the lens 53 of the main body 50 of the present exemplary embodiment is formed of the first lens 54 and the second lens 55, the lens of the main body 50A of the heating section 30A is formed of only a lens 53A which is disposed on the inside of the transparent belt 52. Here, the refractive index of the lens 53A in relation to the beam LB is set to 1.5. Since, unlike the heating section 30 of the present exemplary embodiment, it is necessary for the heating section 30A to focus the beam LB using only the lens 53A, the end portion of the top side of the lens 53A in the apparatus height direction forms a curved surface 54D which protrudes to the top side. The curvature of the curved surface 54D is greater than the curvature of the curved surface 56A2 of the first guide section 56A and the curved surface 56B2 of the second guide section 56B. Therefore, gaps GA1 and GA2 between the curved surface 54D and the inner circumferential surface of the transparent belt 52 are formed at positions in the curved surface 54D other than the topmost portion (hereinafter referred to as a peak portion TS) of the curved surface 54D in the apparatus height direction. Except for the points described above, the configuration of the heating section 30A of the comparative embodiment is the same as that of the heating section 30 of the present exemplary embodiment. Except for the point in which the heating section 30A is provided instead of the heating section 30, the configuration of a fixing device 20A of the comparative embodiment is the same as that of the fixing device 20 of the present exemplary embodiment. Except for the point in which the fixing device 20A is provided instead of the fixing device 20, the configuration of an image forming apparatus 10A of the comparative embodiment is the same as that of the image forming apparatus 10 of the present exemplary embodiment.

In the case of the comparative embodiment, the portion of the transparent belt 52 which faces the curved surface 54D of the lens 53A is separated from the curved surface 54D. Therefore, the transparent belt 52 rotates around the axis while the portion of the transparent belt 52 which faces the curved surface 54D vibrates in the vertical direction (the thickness direction of the transparent belt 52). Therefore, in the comparative embodiment, there is a concern that the beam LB which is transmitted by the transparent belt 52 which vibrated in the vertical direction will be scattered by the transparent belt 52. When the beam LB is scattered by the transparent belt 52, the energy of the beam LB which is focused on the second position of the transparent belt 52 varies due to the time in which the focusing takes place (variation in the focus of the beam).

In contrast, in the case of the heating section 30 of the present exemplary embodiment, as illustrated in FIG. 2, the beam LB which is irradiated by the irradiating section 60 enters the outer circumferential surface of the second lens 55, and is subsequently transmitted by the portion of the transparent belt 52 at which the nip N1 is formed by the first lens 54 and the second lens 55. Therefore, in the heating section 30 of the present exemplary embodiment, the beam LB does not enter the transparent belt 52 which vibrates in the vertical direction as occurs in the heating section 30A of the comparative embodiment.

Therefore, according to the heating section 30 of the present exemplary embodiment, the variation in the focus of the beam may be suppressed in comparison to the heating section 30A of the comparative embodiment. Due to the suppression, according to the fixing device 20 of the present exemplary embodiment, poor fixing caused by the variation in the focus of the beam may be suppressed in comparison to the fixing device 20A of the comparative embodiment. According to the image forming apparatus 10 of the present exemplary embodiment, poor image forming caused by the poor fixing may be suppressed in comparison to the image forming apparatus 10A of the comparative embodiment.

Second Operation

In the comparative embodiment, when a scratch is formed on the outer circumferential surface of the transparent belt 52 with the fixing operation, the beam LB which is irradiated by the irradiating section 60 enters the portion of the transparent belt 52 at which the scratch is formed. There is a concern that when the beam LB enters the portion of the transparent belt 52 at which the scratch is formed, the beam LB will be scattered. When the beam LB is scattered by the portion of the transparent belt 52 at which the scratch is formed, the energy of the beam LB which is focused on the second position of the transparent belt 52 varies due to the rotational period of the transparent belt 52 (variation in the focus of the beam caused by the scratch).

Incidentally, even in the present exemplary embodiment, when a scratch is formed on the outer circumferential surface of the transparent belt 52 with the fixing operation, the beam LB which is irradiated by the irradiating section 60 enters the portion of the transparent belt 52 at which the scratch is formed. However, in the present exemplary embodiment, unlike in the case of the comparative embodiment, the position of the transparent belt 52 which the beam LB enters at which the scratch is formed is nipped by the first lens 54 and the second lens 55. Therefore, according to the heating section 30 of the present exemplary embodiment, the beam LB which enters the portion of the transparent belt 52 at which the scratch is formed is not easily scattered in comparison to the heating section 30A of the comparative embodiment.

Therefore, according to the heating section 30 of the present exemplary embodiment, the variation in the focus of the beam caused by the scratch may be suppressed in comparison to the heating section 30A of the comparative embodiment. Due to the suppression, according to the fixing device 20 of the present exemplary embodiment, poor fixing caused by the variation in the focus of the beam due to the scratch may be suppressed in comparison to the fixing device 20A of the comparative embodiment. According to the image forming apparatus 10 of the present exemplary embodiment, poor image forming caused by the poor fixing may be suppressed in comparison to the image forming apparatus 10A of the comparative embodiment.

Third Operation

As illustrated in FIG. 2, in the heating section 30 of the present exemplary embodiment, the second lens 55 rotates around the axis C. Therefore, in the heating section 30 of the present exemplary embodiment, the drive torque of the transparent belt 52 may be reduced in comparison to a heating section (for example, a heating section 30C of FIG. 6) in which the second lens 55 is fixed. As described earlier, the second lens 55 of the present exemplary embodiment is driven by the drive source (not shown) to rotate around the axis C. Therefore, in the heating section 30 of the present exemplary embodiment, the drive torque of the transparent belt 52 may be reduced in comparison to a heating section in which the second lens 55 follows the transparent belt 52. Note that, the heating section in which the second lens 55 is fixed, the fixing device which is provided with the heating section, and the image forming apparatus belong to the technical scope of the invention.

Fourth Operation

As illustrated in FIG. 2, the concave surface 54A is formed in the first lens 54 of the heating section 30 of the present exemplary embodiment. The second lens 55 of the heating section 30 of the present exemplary embodiment interposes the transparent belt 52 with the portion (the concave portion) of the first lens 54 in which the concave surface 54A is formed to form the nip N1. Therefore, in the heating section 30 of the present exemplary embodiment, the width of the beam LB which is transmitted by the nip N1 as viewed from the apparatus depth direction may be widened in comparison to a heating section (for example, a heating section 30B of FIG. 5) in which the portion of the first lens 54 at which the nip N1 is formed is a curved portion which protrudes to the top side. In other words, in the heating section 30 of the present exemplary embodiment, the width of the luminous flux enters the second lens 55 as viewed from the apparatus depth direction may be widened in comparison to a heating section in which the portion of the first lens 54 at which the nip N1 is formed is a curved portion which protrudes to the top side.

In the heating section 30 of the present exemplary embodiment, the nip N1 is formed by a concave portion in which the concave surface 54A, which has an arc-shaped edge, is formed as viewed from the apparatus depth direction. Therefore, in the heating section 30 of the present exemplary embodiment, the width of the nip N1 as viewed from the apparatus depth direction may be widened in comparison to a heating section in which the portion of the first lens 54 at which the nip N1 is formed is a curved portion which protrudes to the top side. Therefore, in the heating section 30 of the present exemplary embodiment, the nip N1 may be formed in a stable manner in comparison to a heating section in which the portion of the first lens 54 at which the nip N1 is formed is a curved portion which protrudes to the top side.

In the heating section 30 of the present exemplary embodiment, the size of the first lens 54 may be reduced in comparison to a heating section in which the portion of the first lens 54 at which the nip N1 is formed is a curved portion which protrudes to the top side. The reasons are as follows. In other words, the length of the portion of the first lens 54 of the present exemplary embodiment which overlaps the optical axis CL is shorted, by the difference in length, in comparison to the length of the portion of the first lens 54 (for example, the first lens 54 of FIG. 5) in which the portion at which the nip N1 is formed is a curved portion which protrudes to the top side which overlaps the optical axis CL. As described earlier, as viewed from the apparatus depth direction, the length from the position at which the beam LB enters the second lens 55 in the optical axis CL to the second position of the transparent belt 52 is in a relationship of being 1.5 times the diameter of the second lens 55 when ignoring the refractive index of the transparent belt 52. Therefore, the diameter of the second lens 55 of the present exemplary embodiment is shorter than the diameter of the second lens 55 in which the portion which forms the nip N1 is a curved portion which protrudes to the top side. The reasons are described above.

Note that, the heating section in which the portion of the first lens 54 which forms the nip N1 is a curved portion which protrudes to the top side, the fixing device which is provided with the heating section, and the image forming apparatus belong to the technical scope of the invention.

Fifth Operation

As described earlier, the second lens 55 of the heating section 30 of the present exemplary embodiment is harder than the transparent belt 52. Therefore, when the second lens 55 forms the nip N1 with the first lens 54 by interposing the transparent belt 52, the transparent belt 52 is deformed (depressed). Therefore, according to the heating section 30 of the present exemplary embodiment, the second lens 55 does not deform easily in comparison to a heating section (not shown) in which the transparent belt 52 is harder than the second lens 55. Due to this configuration, according to the heating section 30 of the present exemplary embodiment, variation in the optical properties of the second lens 55 caused by the formation of the nip N1 is small in comparison to a heating section in which the transparent belt 52 is harder than the second lens 55. Accordingly, according to the heating section 30 of the present exemplary embodiment, the light convergence density of the beam LB in the second position on which the beam LB is focused may be increased in comparison to a heating section in which the transparent belt 52 is harder than the second lens 55. In other words, according to the heating section 30 of the present exemplary embodiment, a reduction in the light convergence density of the beam LB caused by the formation of the nip N1 may be suppressed in comparison to a heating section in which the transparent belt 52 is harder than the second lens 55.

Second Exemplary Embodiment

Figure 5:
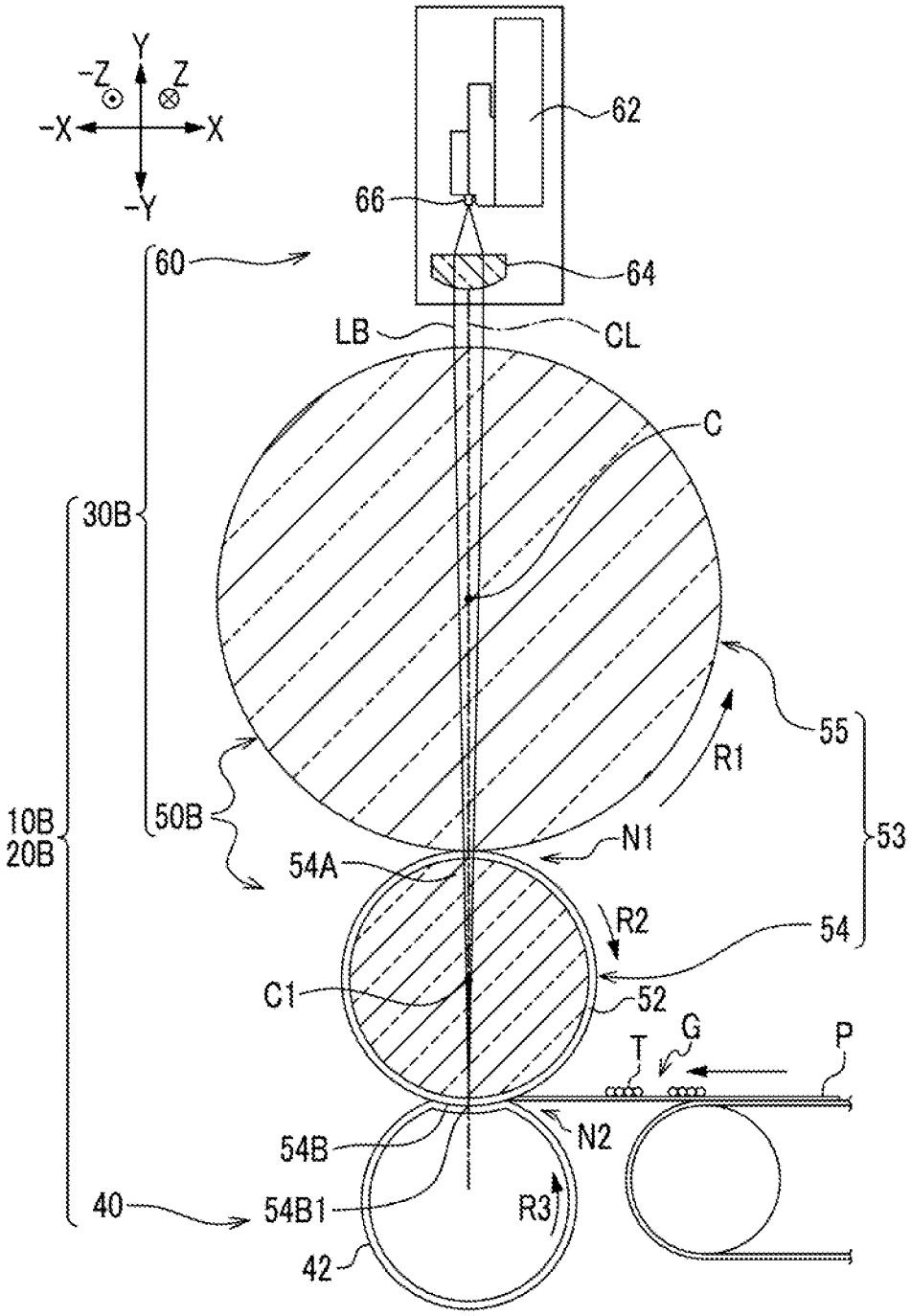
FIG. 5 is a schematic diagram (a front diagram) illustrating a fixing device which configures an image forming apparatus of a second exemplary embodiment.

Next, description will be given of the second exemplary embodiment with reference to FIG. 5. Note that, in the present exemplary embodiment, when the same components as in the image forming apparatus 30 of the first exemplary embodiment are used, the reference numerals and the like of the components and the like are used without change.

Configuration

In the heating section 30B of the present exemplary embodiment, when the first lens 54 which is disposed inside the transparent belt 52 is viewed from the apparatus depth direction, the first lens 54 is a cylinder. The first lens 54 is fitted inside the transparent belt 52, and the inner circumferential surface of the transparent belt 52 is fixed to the outer circumference of the first lens 54 by being adhered using an adhesive which transmits the beam LB. Therefore, the heating section 30B of the present exemplary embodiment is not provided with the guide section 56 and the supply section 58. The first lens 54 rotates around an axis C1 integrally with the transparent belt 52 with the rotation around the axis C1 of the transparent belt 52. The concave surface 54A which forms the nip N1 and the curved surface 54B which forms the nip N2 in the first lens 54 are each a portion of the outer circumferential surface of the first lens 54, and switch places with the rotation of the first lens 54 around the axis C1. Note that, since the nip N1 is formed by the outer circumferential surface of the first lens 54 which is a cylinder and the outer circumferential surface of the second lens 55, as viewed from the apparatus depth direction, the width of the nip N1 of the present exemplary embodiment is narrower than the width of the nip N1 of the first exemplary embodiment. Except for the points described above, the configuration of the heating section 30B of the present exemplary embodiment is the same as that of the heating section 30 of the first exemplary embodiment. Except for the point in which the heating section 30B is provided instead of the heating section 30, the configuration of a fixing device 20B of the present exemplary embodiment is the same as that of the fixing device 20 of the first exemplary embodiment. Except for the point in which the fixing device 20B is provided instead of the fixing device 20, the configuration of an image forming apparatus 10B of the present exemplary embodiment is the same as that of the image forming apparatus 10 of the first exemplary embodiment.

Operations

As described earlier, in the heating section 30B of the present exemplary embodiment, the first lens 54 rotates around the axis C1 integrally with the transparent belt 52. That is, the transparent belt 52 does not slide on the first lens 54. Therefore, according to the heating section 30B of the present exemplary embodiment, the inner circumferential surface of the transparent belt 52 is not easily scratched in comparison to the heating section 30 of the first exemplary embodiment. According to the heating section 30B of the present exemplary embodiment, it is not necessary to apply a lubricant such as silicone oil to the inner circumferential surface of the transparent belt 52. The other operations of the present exemplary embodiment are the same as the operations other than the fourth operation of the first exemplary embodiment.

Third Exemplary Embodiment

Figure 6:
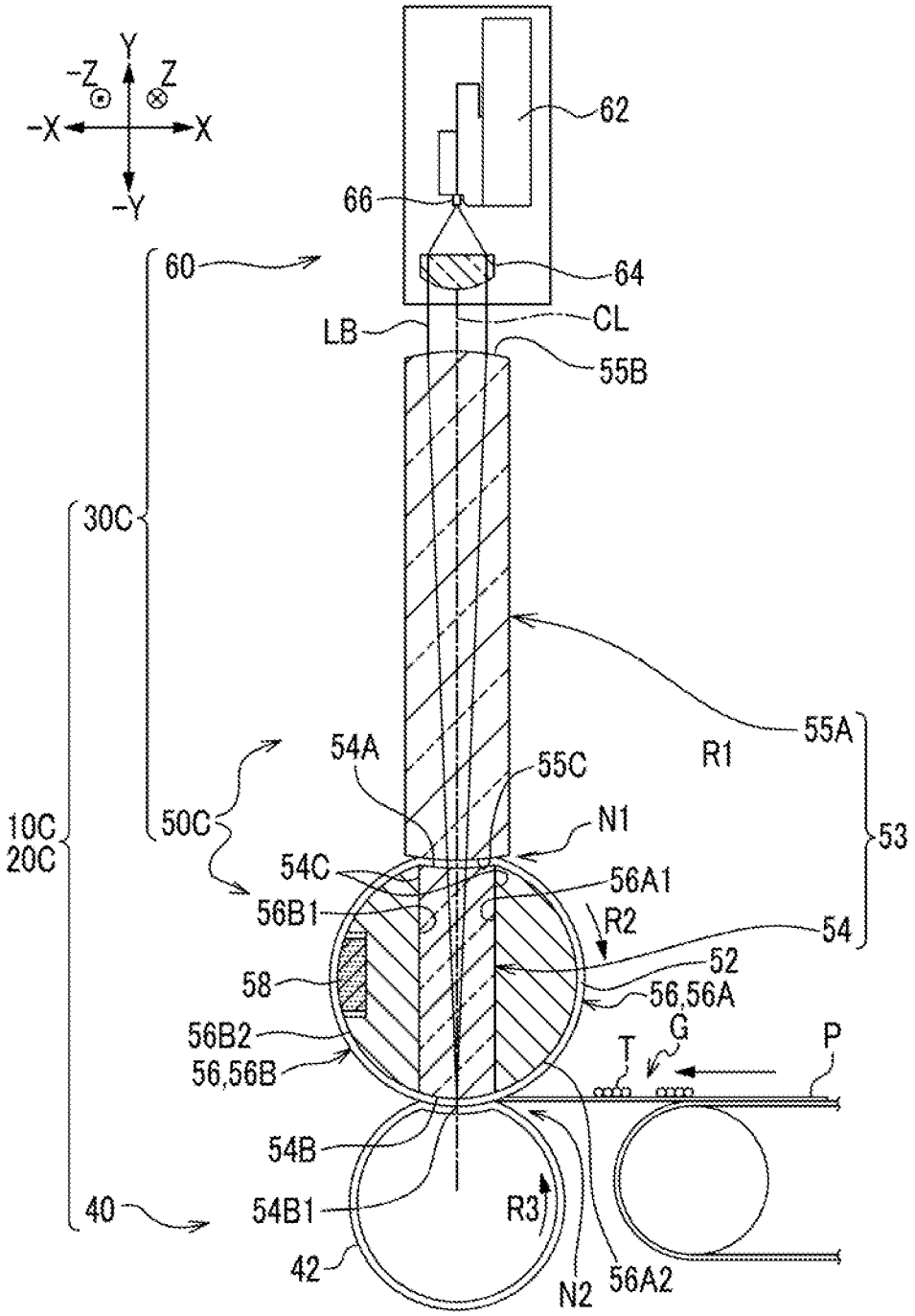
FIG. 6 is a schematic diagram (a front diagram) illustrating a fixing device which configures an image forming apparatus of a third exemplary embodiment.

Next, description will be given of the third exemplary embodiment with reference to FIG. 6. Note that, in the present exemplary embodiment, when the same components as in the image forming apparatus 10 of the first exemplary embodiment are used, the reference numerals and the like of the components and the like are used without change.

Configuration

The heating section 30C of the present exemplary embodiment is provided with a second lens 55A which is long in the vertical direction as viewed from the apparatus depth direction instead of the second lens 53 of the first exemplary embodiment. Curved surfaces 55B and 55C which have the same curvature as the outer circumference of the second lens 55 of the first exemplary embodiment are formed in the top end and the bottom end of the second lens 55A. Unlike the second lens 55 of the first exemplary embodiment, the second lens 55A of the present exemplary embodiment is fixed and does not rotate. Therefore, the second lens 55A is small in the apparatus width direction. In ether words, in a configuration in which the beam LB is irradiated along the apparatus height direction, the width of the second lens 55A is sufficient if the second lens 55A includes a portion which overlaps the collimating lens 64 which configures the irradiating section 60 as viewed from the apparatus height direction. The second lens 55A of the present exemplary embodiment is small in the apparatus width direction in comparison with the second lens 55 of the first exemplary embodiment. Except for the points described above, the configuration of the heating section 30C of the present exemplary embodiment is the same as that of the heating section 30 of the first exemplary embodiment. Except for the point in which the heating section 30C is provided instead of the heating section 30, the configuration of a fixing device 20C of the present exemplary embodiment is the same as that of the fixing device 20 of the first exemplary embodiment. Except for the point in which the fixing device 20C is provided instead of the fixing device 20, the configuration of an image forming apparatus 10C of the present exemplary embodiment is the same as that of the image forming apparatus 10 of the first exemplary embodiment. Note that, the portion of the second lens 55A in which the curved surface 55C is formed interposes the transparent belt 52 with the portion (the concave portion) of the first lens 54 in which the concave surface 54A is formed to form the nip N1.

Operations

In the heating section 30C of the present exemplary embodiment, as described above, the second lens 55A of the present exemplary embodiment is small in the apparatus width direction in comparison with the second lens 55 of the first exemplary embodiment. Therefore, according to the heating section 30C of the present exemplary embodiment, space saving in the apparatus height direction and downsizing may be obtained in comparison to the heating section 30 of the first exemplary embodiment. The other operations of the present exemplary embodiment are the same as the operations other than the third operation of the first exemplary embodiment.

Specific exemplary embodiments of the invention are described above in detail; however, the invention is not limited to the exemplary embodiments described earlier, and other exemplary embodiments may be adopted within the scope of the technical idea of the invention.

For example, a configuration is described in which, in the fixing devices 20 and 20C of the first and third exemplary embodiments, a lubricant (for example, silicone oil) is applied to the inner circumferential surface of the transparent belt 52 by causing the supply section 58 which is impregnated with the silicone oil to come into contact with the inner circumferential surface of the transparent belt 52. However, if the lubricant is applied to the inner circumferential surface of the transparent belt 52, the supply section 58 may not be provided in the fixing devices 20 and 20C.

For example, a configuration is described in which, in the fixing devices 20 and 20C of the first and third exemplary embodiments, a lubricant is applied to the inner circumferential surface of the transparent belt 52 by causing the supply section 58 which is impregnated with the lubricant (for example, the silicone oil) to come into contact with the inner circumferential surface of the transparent belt 52. However, if the transparent belt 52 may rotate around the axis, the lubricant may not be applied to the inner circumferential surface of the transparent belt 52.

A configuration is described in which, in the fixing devices 20, 20B, and 20C of the exemplary embodiments, the cylindrical member 42 which forms the pressurizing section 40 is caused to rotate around the axis by the drive source. However, during the fixing operation, the cylindrical member 42 may form the nip N2 with the transparent belt 52 and rotate around the axis. For example, the cylindrical member 42 may follow the transparent belt 52 to rotate.

A configuration is described in which, in the heating section 30 of the first exemplary embodiment, the lens 53 is formed of the first lens 54 and the second lens 55. However, if the beam LB which enters the first lens 54 may focus on the second position of the transparent belt 52 via the nip N1 and the second lens 54, either one of the first lens 54 and the second lens 55 may not be a lens. The same applies to the cases of the lens 53 which configures the heating section 30B of the second exemplary embodiment and the lens 53 which configures the heating section 30C of the third exemplary embodiment.

In the first exemplary embodiment, the outer circumferential surface of the second lens 55 which the beam LB enters may be covered with an anti-reflective film which reduces the reflectance in relation to the beam LB.

A configuration is described in which, in the heating section 30 of the first exemplary embodiment, the lens 53 is formed of the first lens 54 and the second lens 55. However, in the heating device of the invention, the irradiating section may include a function of irradiating a beam which reaches the second position, which is a position that comes into contact with the heating-target member and which differs from the first position in the circumferential direction of the transparent belt, via the transparent member and the nip. Therefore, for example, if the irradiating section includes the function, the transparent member which configures the heating device of the invention may not be a lens. For example, in the heating device of the invention, another transparent member may not be provided inside the transparent belt. Therefore, the heating device which is provided with a transparent member which is not a lens, is not provided with another transparent member inside the transparent belt, and includes the function is included in the exemplary embodiment of the invention. According to the heating device, variation in the intensity of the beam which reaches the second position may be suppressed in comparison to the heating device in which the transparent member is not provided. Note that, a heating device which heats the heating-target member using a beam which reaches the second position without being focused while transporting the heating-target member is conceivable as an example of the heating device. If the irradiating section includes the function, the transparent member and the other transparent member which configure the other heating device of the invention may not form a lens. Therefore, a heating device which heats the heating-target member which comes into contact with the second position using the beam which is focused on and reaches the second position in the transparent belt after the light which is irradiated by the irradiating section enters the transparent member via a lens which is provided separately is included in the other heating device of the invention. According to the other heating device, variation in the intensity of the beam which is focused on and reaches the second position may be suppressed in comparison to the heating device in which the transparent member is not provided.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating device, comprising:

a transparent belt that travels along a determined path;

a first transparent member that comes into contact with an outer circumferential surface of the belt to form a nip at a first position in the belt; and an irradiating section that irradiates a beam which reaches a second position which comes into contact with a heating-target member and differs from the first position in a circumferential direction of the belt via the transparent member and the nip.

2. The heating device according to claim 1, further comprising:

a second transparent member that forms a nip by interposing the belt with the transparent member at the first position, and together with the transparent member, focuses the beam which enters the first transparent member on the second position via the nip.

3. The heating device according to claim 2, wherein the transparent member is cylindrical, is rotatable around an axis, and rotates around the axis with traveling of the belt.

4. The heating device according to claim 2, wherein a portion of the second transparent member that forms the nip with the first transparent member is a concave portion with a curved shape.

5. The heating device according to claim 3, wherein a portion of the second transparent member that forms the nip with the first transparent member is a concave portion with a curved shape.

6. The heating device according to claim 2, wherein the second transparent member is a cylinder, and wherein the second transparent member is fitted in the belt and fixed to an inner circumferential surface of the belt.

7. The heating device according to claim 3, wherein the second transparent member is a cylinder, and wherein the second transparent member is fitted in the belt and fixed to an inner circumferential surface of the belt.

8. The heating device according to claim 4, wherein the second transparent member is a cylinder, and wherein the second transparent member is fitted in the belt and fixed to an inner circumferential surface of the belt.

9. The heating device according to claim 5, wherein the second transparent member is a cylinder, and wherein the second transparent member is fitted in the belt and fixed to an inner circumferential surface of the belt.

10. The heating device according to claim 2, wherein the transparent member is harder than the belt.

11. The heating device according to claim 3, wherein the transparent member is harder than the belt.

12. The heating device according to claim 4, wherein the transparent member is harder than the belt.

13. The heating device according to claim 5, wherein the transparent member is harder than the belt.

14. The heating device according to claim 6, wherein the transparent member is harder than the belt.

15. The heating device according to claim 7, wherein the transparent member is harder than the belt.

16. The heating device according to claim 8, wherein the transparent member is harder than the belt.

17. The heating device according to claim 9, wherein the transparent member is harder than the belt.

18. A fixing device, comprising:

the heating device according to claim 2; and a pressurizing section that is provided on an outside of the belt, interposes the belt with the second transparent member to form a nip at the second position, and pressurizes a developer image on a medium as the heating-target member on the nip at the second position.

19. An image forming apparatus, comprising:

a forming unit that forms a developer image on the medium; and the fixing device according to claim 18 that fixes the developer image to the medium.

* * * * *